US007722757B1

(12) United States Patent
Miller et al.

(10) Patent No.: US 7,722,757 B1
(45) Date of Patent: May 25, 2010

(54) PROCESS FOR THE PRODUCTION OF HYDROGEN FROM WATER

(75) Inventors: William E. Miller, Naperville, IL (US); Victor A. Maroni, Naperville, IL (US); James L. Willit, Batavia, IL (US)

(73) Assignee: The United States of America as represented by the United States Department of Energy, Washington, DC (US)

( * ) Notice: Subject to any disclaimer, the term of this patent is extended or adjusted under 35 U.S.C. 154(b) by 908 days.

(21) Appl. No.: 11/536,979

(22) Filed: Sep. 29, 2006

(51) Int. Cl.
*C25B 1/02* (2006.01)
*C25B 9/00* (2006.01)

(52) U.S. Cl. ..... 205/637; 205/628; 205/630; 205/631; 205/638; 205/639; 204/242; 204/243.1; 204/252

(58) Field of Classification Search ..... 205/628, 205/630, 631, 637, 638, 639; 204/242, 252, 204/243.1

See application file for complete search history.

(56) References Cited

U.S. PATENT DOCUMENTS 4,235,863 A * 11/1980 Schulten et al. ..... 423/658.2
2002/0037452 A1* 3/2002 Schmidt ..... 429/218.1
2006/0180464 A1* 8/2006 Griffin ..... 204/280

* cited by examiner

*Primary Examiner*—Harry D. Wilkins, III
*Assistant Examiner*—Nicholas A. Smith
(74) *Attorney, Agent, or Firm*—Michael J. Dobbs; Bradley W. Smith; Paul A. Gottlieb

(57) ABSTRACT

A method and device for the production of hydrogen from water and electricity using an active metal alloy. The active metal alloy reacts with water producing hydrogen and a metal hydroxide. The metal hydroxide is consumed, restoring the active metal alloy, by applying a voltage between the active metal alloy and the metal hydroxide. As the process is sustainable, only water and electricity is required to sustain the reaction generating hydrogen.

19 Claims, 3 Drawing Sheets

PROCESS FOR THE PRODUCTION OF HYDROGEN FROM WATER

GOVERNMENT INTERESTS

The United States Government has rights in this invention pursuant to Contract No. W-31-109-ENG-38, between the U.S. Department of Energy (DOE) and the University of Chicago.

FIELD OF THE INVENTION

The present invention relates to the efficient production of hydrogen from water.

BACKGROUND OF THE INVENTION

The efficient production of hydrogen is not only critical to a number of industrial processes, but plays a key part in creating a clean and efficient hydrogen economy. The idea of a fuel cell, able to convert hydrogen into water and electricity, has been around for over a century. The fuel cell however, has been ineffective as a viable commercial power source because of inefficiencies in the production of hydrogen. Hydrogen can be produced by many different methods. Common methods of producing hydrogen are steam reformation (SR), highly reactive metals, reactive metals, electrolysis, and high temperature electrolysis (HTE).

Steam reformation (SR) is believed to be the most economical and commercially viable process that is presently available. At high temperatures (700-1100° C.) and in the presence of a metal-based catalyst, steam reacts with a hydrocarbon, such as methane, to yield carbon monoxide and hydrogen. For most hydrocarbons, including methane, temperatures in excess of 700° C. are necessary. Carbon monoxide produced in the SR reaction is poisonous to most fuel cells. The carbon monoxide may be processed in a water gas shift reaction (WGS), an organic reaction which combines carbon monoxide with steam to produce hydrogen. Unfortunately, the WGS does not consume all the carbon monoxide requiring the fuel cell to be periodically cleaned. The carbon monoxide can also be partially removed by scrubbing or pressure swing adsorption, both of which are costly.

Highly reactive metals may also be used to produce hydrogen from water. Examples of such metals include: lithium (Li), sodium (Na), potassium (K), rubidium (Rb), cesium (Cs), francium (Fr), beryllium (Be), magnesium (Mg), calcium (Ca), strontium (Sr), barium (Ba), radium (Ra), aluminum (Al), silicon (Si), phosphorus, (P), titanium (Ti), vanadium (V), chromium (Cr), manganese (Mn), yttrium (Y), zirconium (Zr), niobium (Nb), lanthanum (La), hafnium (Hf), tantalum (Ta) and gallium (Ga). These metals oxidize in the presence of water creating hydrogen. Unfortunately they cannot be efficiently reduced back to the original metal.

Reactive metals have a reactivity less than the highly reactive metals, but are much more capable of being reduced back to the original metal once oxidized. Examples of reactive metals include: germanium (Ge), iron (Fe), zinc (Zn), tungsten (W), molybdenum (Mo), indium (In), tin (Sn), cobalt (Co) and antimony (Sb). The reduction/oxidation of iron was used as the primary industrial method for manufacturing hydrogen during the $19^{th}$ and early $20^{th}$ centuries. At elevated temperatures, iron strips oxygen from water, leaving pure hydrogen. Excess water is required to maximize hydrogen production from a given amount of iron. After the hydrogen is produced, excess water is condensed leaving an uncontaminated hydrogen gas steam. The steam reduction/iron oxidation process produces hydrogen and wustite (FeO) and/or magnetite ($Fe_3O_4$). To regenerate the iron metal, carbon monoxide or carbon is used to capture the oxygen from the iron oxide, forming iron metal and carbon monoxide (CO) or carbon dioxide ($CO_2$). Another method of reducing the iron oxide is smelting the iron oxide, which requires high temperature due to the high melting point of iron (1538° C.). Unfortunately, both these methods are inefficient and kinetically difficult.

Electrolysis is a simple way of producing hydrogen. In electrolysis, an electrical current is applied between a pair of inert electrodes immersed in water. The amount of electrical energy that must be used equals the change in Gibbs free energy of the reaction plus the losses in the system. The losses can (theoretically) be arbitrarily close to zero, so the maximum thermodynamic efficiency equals the Gibbs free energy change of the reaction divided by the enthalpy change.

High temperature electrolysis (HTE) may also be used to produce hydrogen at as high as twice the efficiently of simple room temperature electrolysis. HTE is more efficient than simple room temperature electrolysis because some of the energy is supplied as heat, which is cheaper than electricity, and because the electrolysis reaction is more efficient at higher temperatures. In fact, at 2500° C., an electrical current is unnecessary because water breaks down to hydrogen and oxygen through thermolysis. However, such temperatures are impractical. Proposed HTE systems operate at 100 to 850° C. HTE has been demonstrated in a laboratory, but not on a commercial scale. Unfortunately a significant amount of energy is lost in HTE electrolysis from the high pressures the water must be exposed to in order to maintain it as a liquid.

Therefore there exists a need for a more efficient method of producing hydrogen. An object of the following invention is for a continuous, self-renewing method of producing hydrogen, requiring only a supply of steam and electricity once started. A further object of the following invention is a method of producing hydrogen at temperatures above the boiling point of water, without having to maintain the reaction at higher pressures. Still yet another object of the following invention is a method of producing hydrogen with about a 30% increase in efficiency over HTE.

SUMMARY OF THE INVENTION

A method and device for the production of hydrogen from water and electricity using an active metal alloy. An active metal alloy layer is formed at the base of a container and continuously exposed to steam, producing a metal hydroxide layer above the active metal alloy layer, and hydrogen. At the same time, a voltage is continuously applied between the metal hydroxide layer and the active metal alloy layer, causing a reaction consuming the metal hydroxide layer and restoring the active metal alloy layer, while also producing more hydrogen. The hydrogen produced from the active metal alloy layer and the metal hydroxide layer is collected.

DETAILED DESCRIPTION OF THE INVENTION

A method and device for the production of hydrogen through the employment of water and electricity using an active metal alloy. A liquid active metal alloy is placed in the base of a container forming an active metal alloy layer. The active metal alloy layer is continuously exposed to steam, creating a metal hydroxide, and hydrogen. The metal hydroxide, being less dense than and immiscible with the active metal alloy forms a metal hydroxide layer within the container and above the active metal alloy layer. A voltage is continuously applied to electrodes located in the metal hydroxide layer and the active metal alloy layer causing a reaction consuming the metal hydroxide layer and producing the active metal alloy, oxygen, and additional hydrogen. The active metal alloy replenishes the active metal alloy layer, and the hydrogen is collected by a trapping means.

Figure 1:
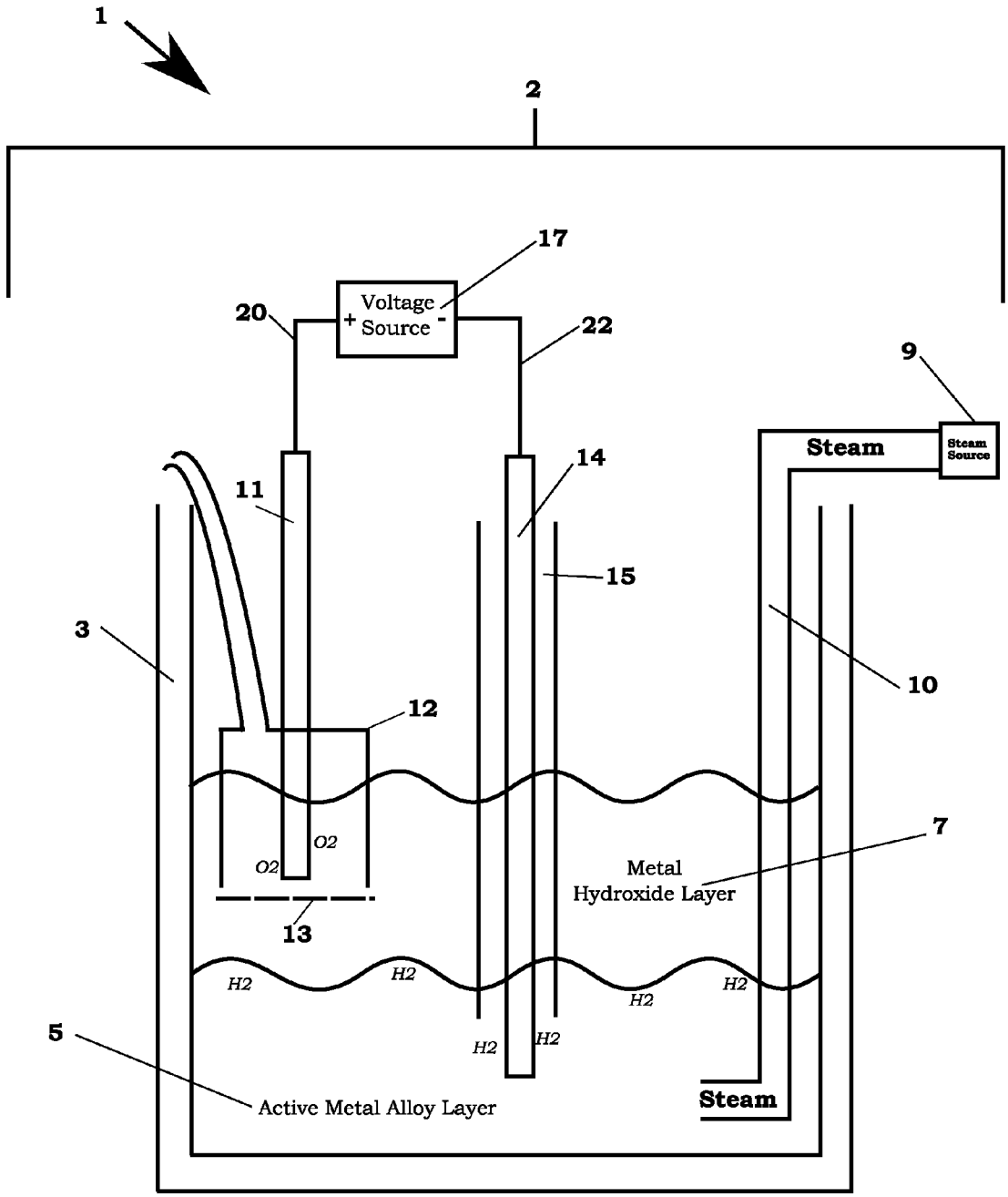
FIG. 1 depicts a simple reactor producing hydrogen from the employment of electricity and a steam source.

FIG. 1 depicts an embodiment of a simple reactor 1 producing hydrogen through the employment of electricity and a steam source. The reactor 1 comprises a container 3, an active metal alloy layer 5, a metal hydroxide layer 7, and a steam source 9. An active metal alloy is placed into the container 3, forming the active metal alloy layer 5, a liquid. The active metal layer 5 is exposed to a stream of steam from the steam source 9 causing a first (chemical) reaction:

$$K—Bi+H_2O \rightarrow KOH+\tfrac{1}{2}H_2+Bi \qquad \text{(Reaction 1)}$$

producing hydrogen and a metal hydroxide. The metal hydroxide forms the metal hydroxide layer 7 above the active metal alloy layer 5. The hydrogen forms at the interface of the active metal alloy layer 5 and the metal hydroxide layer 7. The hydrogen, having a lower density than the active metal alloy layer 5 and the metal hydroxide layer 7, ascends above both layers and is captured, preferably by a closed vessel 2 positioned above the container 3.

A voltage source 17 supplies a voltage across the metal hydroxide layer 7 and the active metal alloy layer 5 via a first electrode 11, and a second electrode 14 respectively. The second electrode 14 has an insulator 15 electrically insulating the second electrode 14 from the metal hydroxide layer 7.

Additional hydrogen is generated, from a second (electrochemical) reaction:

$$KOH+Bi+e^- \rightarrow K—Bi+\tfrac{1}{2}H_2+\tfrac{1}{2}O_2 \qquad \text{(Reaction 2)}$$

at the active metal alloy layer 5 and the metal hydroxide layer 7 interface. A voltage is supplied to the active metal alloy layer 5 via the second electrode 14, which is submersed through the metal hydroxide layer 7 in the active metal alloy layer 5. Oxygen is generated from the second reaction at the end of the first electrode 11, which is submersed in the metal hydroxide layer 7. In the preferred embodiment, oxygen produced at the first electrode 11 is preferably captured and sequestered by a shroud 12 over the first electrode 11. Hydrogen produced at the interface of the active metal alloy layer 5 and the metal hydroxide layer 7, is preferably captured by a closed vessel 2 over the container 3. Some steam will not react with the active metal alloy layer 5, and will ascend with the hydrogen, preferably into the closed vessel 2. In the preferred embodiment, the hydrogen and steam captured by the closed vessel 2 is processed to separate the steam and the hydrogen. Likewise un-reacted steam will ascend into the anode shroud and accompany the evolved oxygen.

The container 3 has a shape whereby the active metal alloy layer 5 and the metal hydroxide layer 7 are contained within the container 3. The container 3 is made of a material which does not dissolve and is resistant to heat from the active metal alloy layer 5, metal hydroxide layer 7, steam from the steam source 9, and combinations thereof. In the preferred embodiment, the container 3 is a cylindrical, closed-end tube, made of iron, having an open top, although any shape may be used. In the preferred embodiment, the entire container 3 or the inside walls of the container 3 contacted by the metal hydroxide layer 7 is electrically insulating. Insulating the container 3 prevents the electrochemical reduction of the active metal in the active metal alloy layer 5 from occurring away from the interface of the active metal alloy layer 5 and the metal hydroxide layer 7.

The active metal alloy layer 5 contains a combination of an active metal and a diluent. The active metal is a metal that is reactive to water. The diluent is an inert (unreactive) liquid or solvent. The active metal is preferably sodium (Na), potassium (K), lithium (Li), cesium (Cs), calcium (Ca), or combinations thereof. The diluent is preferably bismuth (Bi), lead (Pb), tin (Sn), tellerium (Te), or combinations thereof. The active metal alloy layer 5, is maintained at a temperature whereby the active metal alloy layer 5 is a liquid. As a liquid, more of the active metal in the active metal alloy layer 5 will be able to more readily react with steam. In the preferred embodiment, K, an active metal, is mixed with molten Bi, a diluent, producing Bi dissolved in K and possibly a small amount of $K_3Bi$ (solids). The K, Bi and $K_3Bi$ each react with the steam producing metal hydroxide. Preferably, the Bi and K are mixed at about 700 K (Kelvin), which is above the melting point of KOH and above the liquidus of K-15 mol %/Bi-85 mol % solution. Preferably, the surface of the metal hydroxide layer 7 is exposed to a pressure less than about 10 ATM (atmospheres), more preferably the surface of the metal hydroxide layer 7 is at about atmospheric pressure.

The steam source 9 produces $H_2O$ (steam) which is distributed to the active metal alloy layer 5. Preferably, the steam is distributed via a graphite or metal pipe, more preferably, an iron or low chromium-moly steel pipe. In the preferred embodiment, the steam is distributed via a bent pipe 10. The bent pipe 10 is preferably electrically insulated from the metal hydroxide layer 7. Other distribution means known in the art may also be used, such as a perforated pipe running along the bottom of the container 3, or perforations in the container 3 allowing steam to pass through the container 3, from an outside source. The active metal alloy layer 5 reacts with the steam raising the temperature (exothermic reaction), and creating hydrogen, and a metal hydroxide which replenishes the metal hydroxide layer 7. The steam is at a temperature which keeps the active metal alloy layer 5 as a liquid. Preferably, the steam is at the same temperature as the active metal alloy layer 5. When the preferred K—Bi active metal alloy is used, the steam is preferably at a temperature of about 700-900 K to keep the K—Bi in liquid form.

The metal hydroxide layer 7 is a layer having a metal hydroxide produced from the reaction of the active metal alloy layer 5 and steam from the steam source 9. In the preferred embodiment, the metal hydroxide layer 7 is liquid KOH.

The voltage source 17 is capable of continuously producing a voltage. The voltage source 17 is electrically connected to the first electrode 11, preferably by a first connector 20. The first electrode 11 is submersed in the metal hydroxide layer 7 completing the electrical connection between the voltage source 17 and the metal hydroxide layer 7. Likewise, the voltage source 17 is electrically connected to the second electrode 14, preferably by a second connector 22. The second electrode 14 is submersed in the active metal alloy layer 5 completing the electrical connection between the voltage source 17 and the active metal alloy layer 5. In the preferred embodiment, the second electrode 14 is electrically isolated from the metal hydroxide layer 7 by the insulator 15.

The first electrode 11 is made of an electrically conductive material and electrically connects the voltage source 17 to the metal hydroxide layer 7. The first electrode 11 is made of a material capable of withstanding the temperature of the metal hydroxide layer 7. Preferably, the first electrode 11 is made of a material that does not corrode in the metal hydroxide layer 7. Preferably, the first electrode 11 is made of platinum, $RuO_2$, or other stable, inert, oxygen anodes. More preferably, the first electrode 11 is made of platinum (Pt).

The second electrode 14 is made of an electrically conductive material and electrically connects the voltage source 17 to the active metal alloy layer 5. Preferably, the second electrode 14 is a graphite or metal conductor such as low chrome/moly steel which does not dissolve or corrode in the active metal alloy layer 5. In the preferred embodiment, the second electrode 14, is made of iron. In the alternative, the second electrode 14 is omitted and an electrically conductive container 3 is used as the second electrode 14. In this embodiment, the metal hydroxide layer 7 would be insulated from the container, preferably by a coating on the inside walls of the container.

The insulation 15 of the second electrode 14 electrically isolates the second electrode 14 from the metal hydroxide layer 7, and is preferably a ceramic oxide. More preferably, the insulation 15 is zirconium dioxide ($ZrO_2$) or magnesium oxide (MgO). The insulation 15 is made of a material capable of withstanding the temperature and does not dissolve in the metal hydroxide layer 7, or the active metal alloy layer 5.

In the alternative, the container 3 is electrically conductive and provides a current path between the voltage source 17 and the active metal alloy layer 5. The steam source 9 is insulated from the metal hydroxide layer 7, or fed into the active metal alloy layer 5 below the active metal alloy layer 5 and metal hydroxide layer 7 interface.

The shroud 12 is preferably made of glass and has a bottom enclosure to prevent hydrogen from being sequestered with oxygen. Preferably, a diffusion barrier or frit is used to prevent hydrogen from being sequestered. In the preferred embodiment, the shroud has a frit 13 between the first electrode 11 and the interface between the active metal alloy layer 5 and the metal hydroxide layer 7, whereby hydrogen is deflected off the frit, and the metal hydroxide layer 7 is in contact with the first electrode 11.

The voltage supplied by the voltage source 17 is about the standard reference voltage of the metal hydroxide layer 7, about enough to break down some of the metal hydroxide layer 7, while also consuming heat (endothermic reaction). The breakdown of the metal hydroxide layer 7, from the second reaction, replenishes the active metal alloy layer 5, while also producing hydrogen and oxygen. The oxygen is sequestered by the shroud 12 above the first electrode 11, and the resulting hydrogen and steam that did not react with the active metal alloy layer 5 is captured by the closed vessel 2 above the container 3. A selected voltage is applied to the electrodes to replenish the active metal alloy layer 5. Preferably, the voltage supplied by the voltage source 17 is the voltage resulting in the lowest energy used by the reactor per mole of hydrogen. The energy used will depend upon temperature, voltage, and steam recuperation used in the production of hydrogen. Although the breakdown of the metal hydroxide layer 7 consumes heat, the creation of the metal hydroxide layer 7 generates a comparable amount of heat, making the reaction approximately thermoneutral (not generating or consuming heat).

In the preferred embodiment, the active metal alloy layer 5 is K—Bi (bismuth dissolved in potassium), produced by mixing molten Bi with K. A small amount of $K_3Bi$ is also produced as an intermediate compound. Any $K_3Bi$ reacts with the water in steam in a similar reaction creating KOH and hydrogen. A steam at about 700-900 K from the steam source 9 is introduced by the bent pipe 10 creating the following reaction of Reaction 1:

$$K—Bi+H_2O \rightarrow KOH+\tfrac{1}{2}H_2+Bi \qquad \text{(Reaction 1)}$$

K, the reactive metal, makes the reaction of Reaction 1 exothermic. However the reaction of Reaction 1 is significantly slowed to a less violent reaction by Bi, which both lowers the chemical activity of K and serves as a diluent. As shown in Reaction 1, steam ($H_2O$) and the active metal alloy layer 5 (K—Bi) are consumed producing the metal Hydroxide layer 7 (KOH) and hydrogen. The hydrogen forms at the interface between the active metal alloy layer 5 and the metal hydroxide layer 7.

A voltage is then applied across the metal hydroxide layer 7 and the active metal alloy layer 5 in the following reaction of Reaction 2:

$$KOH+Bi+e^- \rightarrow K—Bi+\tfrac{1}{2}H_2+\tfrac{1}{2}O_2 \qquad \text{(Reaction 2)}$$

As shown in Reaction 2, KOH (the metal hydroxide layer 7) and $e^-$ (electrons from the voltage source 17) react producing K—Bi (replenishing the active metal alloy layer 5), oxygen ($O_2$) and hydrogen ($H_2$). The oxygen ($O_2$) is produced at the end of the first electrode 11. The hydrogen is produced at the interface of the active metal alloy layer 5 and the metal hydroxide layer 7. The rate of reaction 1 (formation of KOH) is largely controlled by the rate of the steam feed. The rate of reaction 2 (electrolytic decomposition of KOH) can be adjusted by control of the applied potential. In this reactor these two rates are about equal so that a state of dynamic equilibrium exists in the cell.

From the Nernst equation applied to reaction 2, the cell voltage $E_{cell}$ is:

$$E_{cell} = \left(\frac{4.184 \cdot \Delta G_{H_2O,g}}{2F}\right) - \left(\frac{RT}{2F}\right)\left[\ln\frac{p_{H_2} \cdot (p_{O_2})^{1/2}}{P_{H_2O}}\right] - \left(\frac{4.184 \cdot \Delta G_{KOH-O}}{2F}\right) + \left(\frac{4.184 \cdot \Delta G_{KOH-H}}{2F}\right) \qquad \text{(Eq. 1)}$$

Where $\Delta G_{KOH—H}$ is the Gibbs free energy for the formation of KOH into H, $\Delta G_{KOH—O}$ is the Gibbs free energy for the decomposition of KOH, $\Delta G_{H2O}$ is the Gibbs free energy for the formation of $H_2O$ (steam); F is Faraday's constant; R is the universal gas constant; T is the temperature of the KOH (metal hydroxide layer 7); $p(H_2)$ is the partial pressure of hydrogen ($H_2$); $p(H_2O)$ is the partial pressure of water ($H_2O$); and $p(O_2)$ is the partial pressure of oxygen ($O_2$). $\Delta G_{KOH—H}$ and $\Delta G_{KOH—O}$ have the same absolute value but are of opposite signs. Therefore $E_{cell}$ reduces to:

$$E_{cell} = \left(\frac{4.184 \cdot \Delta G_{H_2O,g}}{2F}\right) - \left(\frac{RT}{2F}\right)\left[\ln\frac{p_{H_2} \cdot (p_{O_2})^{1/2}}{p_{H_2O}}\right] \qquad \text{(Eq. 2)}$$

Where $\Delta G_{H_2O,g}$ is the Gibbs standard free energy for the formation $H_2O$ (steam) from $H_2$ (gas) and $O_2$ (gas); F is Faraday's constant; R is the universal gas constant; T is the temperature of the KOH (metal hydroxide layer 7); $p_{H_2}$ is the partial pressure of hydrogen ($H_2$); $p_{H_2O}$ is the partial pressure of water ($H_2O$); and $p_{O_2}$ is the partial pressure of oxygen ($O_2$). Instead of the partial pressure of H, O, and water the yield (i.e. moles of H per mole of water) as 'x' may be substituted using the following Eq. 3.

$$\left[\ln\frac{p_{H_2}\cdot(p_{O_2})^{1/2}}{p_{H_2O}}\right]=\ln\left[\frac{3x}{2(x-1)}\sqrt{\frac{3x}{x+2}}\right] \quad \text{(Eq. 3)}$$

Figure 2:
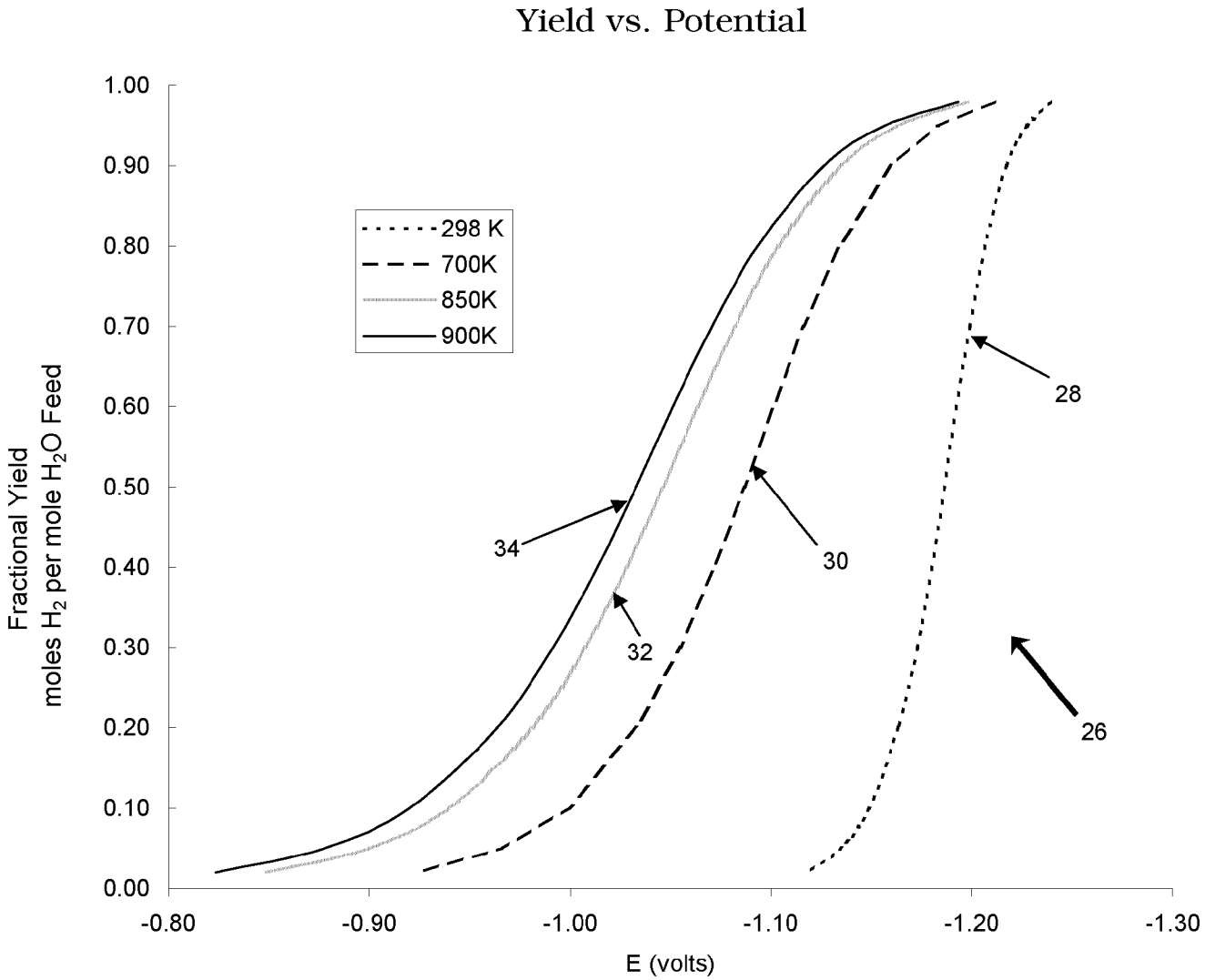
FIG. 2 depicts a plot of the yield (moles of hydrogen per moles of water) of a reactor using a K—Bi active metal alloy layer for a given voltage and temperature.

Therefore the voltage of the cell and the yield are directly related by the following Eq. 4:

$$E_{cell}=\left(\frac{4.184\cdot\Delta G_{H_2O,g}}{2F}\right)-\left(\frac{RT}{2F}\right)\ln\left[\frac{3x}{2(x-1)}\sqrt{\frac{3x}{x+2}}\right] \quad \text{(Eq. 4)}$$

Where x is the yield (moles of H per mole of water fed) and $E_{cell}$ is the energy in volts applied to the cell. FIG. 2 shows a graph of the yield (moles of hydrogen per mole of water fed) 26 for a voltage given the temperature of the metal hydroxide layer 7. The yield for a given voltage is shown for 298 K, 700 K, 850 K, 900 K at atmospheric pressure as 28, 30, 32, 34 respectively. As shown in FIG. 2, there is little increase in yield after about 1.2 Volts. Eq. 4 as well as FIG. 2, can be approximated for all active metal alloys, since all the active metals alloys have a similar response, producing a strong majority of hydrogen from the Reaction 1.

Figure 3:
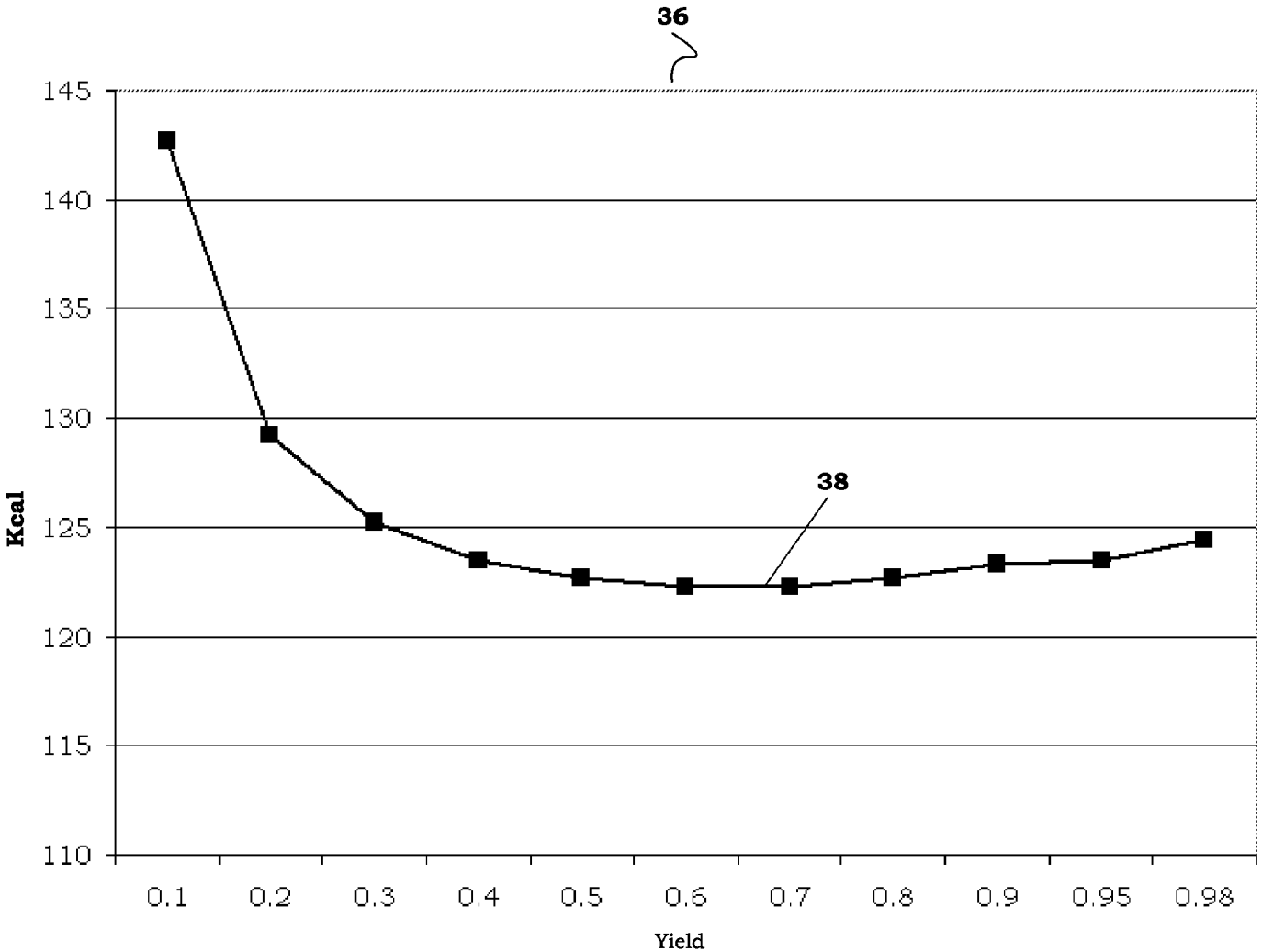
FIG. 3 depicts a plot of the total energy used by a reactor using a K—Bi active metal alloy layer given the yield (moles of hydrogen per moles of water) of the reactor.

Preferably, the voltage is selected by calculating the voltage at which the least amount of energy is used to produce a mole of hydrogen. In the preferred embodiment, using K—Bi as the active metal alloy, the voltage, steam ($H_2O$) recovery, and steam ($H_2O$) feed are accounted for, giving an ideal yield 38 of about 68%, as shown in FIG. 3. As shown in FIG. 2, for a 68% yield about 1.0 to 1.2 volts is preferable, more preferably 1.05 to about 1.15. For a K—Bi active metal alloy at about 900 K, 850 K, 750 K a voltage of about 1.07, 1.07, 1.11 Volts respectively are preferable.

It is to be understood that the above-described arrangements are only illustrative of the application of the principles of the present invention. Numerous modifications and alternative arrangements may be devised by those skilled in the art without departing from the spirit and scope of the present invention and the appended claims are intended to cover such modifications and arrangements.

All publications and patent documents cited in this application are incorporated by reference in their entirety for all purposes to the same extent as if each individual publication or patent document were so individually denoted.

Any element in a claim that does not explicitly state "means for" performing a specified function, or "step for" performing a specific function, is not to be interpreted as a "means" or "step" clause as specified in 35 U.S.C. §112, ¶6. In particular, the use of "step of" in the claims herein is not intended to invoke the provisions of 35 U.S.C. §112, ¶6.

What is claimed is:

1. A method of producing hydrogen comprising the steps of: a. selecting an active metal alloy comprising a metal from the group consisting of lithium (Li), sodium (Na), potassium (K), rubidium (Rb), cesium (Cs), francium (Fr), calcium (Ca) and combinations thereof; b. creating an active metal alloy layer at a base of a container with said active metal alloy; c. continuously applying steam to said active metal alloy causing a first reaction producing hydrogen and a metal hydroxide whereby said metal hydroxide forms into a metal hydroxide layer above said active metal alloy layer whereby said metal hydroxide layer forms above said active metal alloy layer due to the lower density of said metal hydroxide layer; d. positioning a first electrode such that the first electrode is electrically connected to said metal hydroxide layer; e. positioning a second electrode such that the second electrode is electrically connected to said active metal alloy layer; f. continuously applying a voltage across said first electrode and said second electrode causing a second reaction producing hydrogen and said active metal alloy; and g. continuously collecting said hydrogen from said first reaction and said second reaction.

2. The method of producing hydrogen of claim 1 whereby said active metal alloy contains potassium (K).

3. The method of producing hydrogen of claim 1 whereby said active metal alloy comprises a diluent from the group consisting of bismuth (Bi), lead (Pb), Tin (Sn), tellurium (Te), and combinations thereof.

4. The method of producing hydrogen of claim 1 whereby said active metal alloy comprises bismuth (Bi).

5. The method of producing hydrogen of claim 1 whereby:

a. said metal hydroxide layer has a surface; and b. said surface exposed to a pressure less than about 10 ATM.

6. The method of producing hydrogen of claim 5 whereby said pressure is about atmospheric pressure.

7. The method of producing hydrogen of claim 1 whereby said steam has a temperature of about 700-900 K.

8. The method of producing hydrogen of claim 1 whereby said voltage is between about 1.0 to 1.2 Volts.

9. The method of producing hydrogen of claim 1 whereby said voltage is between about 1.05 to 1.15 Volts.

10. The method of producing hydrogen of claim 1 whereby said voltage is selected in order to maintain said active metal alloy layer and said metal hydroxide layer.

11. A device for the production of hydrogen comprising: a. a container having a base; b. an active metal alloy layer positioned in said container above said base and comprising an active metal alloy and contained by said container, wherein the active metal alloy comprises a metal from the group consisting of lithium (Li), sodium (Na), potassium (K), rubidium (Rb), cesium (Cs), francium (Fr), calcium (Ca) and combinations thereof; c. a metal hydroxide layer contained by said container and positioned adjacent to and above said active metal alloy layer; d. a steam source having a means for exposing said active metal alloy layer to steam; e. a voltage source; f. a first electrode electrically connected to said voltage source and said metal hydroxide layer; g. a second electrode electrically connected to said voltage source and said active metal alloy layer; h. said second electrode electrically insulated from said metal hydroxide layer; i. a means for collecting oxygen ascending from said first electrode; and j. a means for collecting hydrogen ascending from said container.

12. The device for the production of hydrogen of claim 11 whereby said active metal alloy comprises potassium (K).

13. The device for the production of hydrogen of claim 11 whereby said active metal alloy comprises a diluent selected from the group consisting of bismuth (Bi), lead (Pb), Tin (Sn), tellurium (Te), and combinations thereof.

14. The device for the production of hydrogen of claim 11 whereby said active metal alloy comprises bismuth (Bi).

15. The device for the production of hydrogen of claim 11 whereby: a. said metal hydroxide layer has a surface; and b. said surface is exposed to a pressure less than about 10 ATM.

16. The device for the production of hydrogen of claim 15 whereby said pressure is about atmospheric pressure.

17. The device for the production of hydrogen of claim 11 whereby said steam has a temperature of about 700-900 K.

18. The device for the production of hydrogen of claim 11 whereby said voltage source produces a voltage between about 1.0 to 1.2 Volts.

19. The device for the production of hydrogen of claim 11 whereby said voltage source produces a voltage between about 1.05 to 1.15 Volts.

* * * * *